United States Patent [19]

Bielawski

[11] 4,093,074

[45] June 6, 1978

[54] ENVELOPES

[76] Inventor: William E. Bielawski, 19 James Pl., Fredonia, N.Y. 14063

[21] Appl. No.: 809,631

[22] Filed: Jun. 24, 1977

[51] Int. Cl.[2] ..... B65D 27/34

[52] U.S. Cl. ..... 206/629; 206/632; 229/81

[58] Field of Search ..... 229/81, 82, 84; 206/632, 629, 620

[56] References Cited

U.S. PATENT DOCUMENTS

| | | | |
|---|---|---|---|
| 1,039,252 | 9/1912 | Caldwell | 229/82 |
| 1,198,288 | 9/1916 | Taylor, Jr. | 229/81 |
| 2,083,158 | 6/1937 | Ramsey | 229/85 |
| 2,129,705 | 9/1938 | Reineman | 229/81 |
| 2,389,747 | 11/1945 | Stone et al. | 229/85 |
| 2,833,461 | 5/1958 | Brom | 206/620 |
| 3,853,262 | 12/1974 | Tucker et al. | 229/85 |

*Primary Examiner*—Stephen P. Garbe

*Attorney, Agent, or Firm*—Sommer & Sommer

[57] ABSTRACT

The present invention provides unique improvements in an envelope having a front panel, a top flap, a bottom flap, and two side flaps. In one form, an improved bottom flap is provided with a substantially T-shaped portion having a leg glued to the side flaps, and having two wings extending laterally from the leg but not attached to the side flaps. The top flap is provided with cooperatively-spaced glued portions which may adhere to the wings but not to the leg. When the envelope is opened, the wings are torn from the leg. Another form of the improved envelope is top loading and bottom opening. In this form, marginal portions of the side flaps are provided with a plurality of inverted, substantially U-shaped slits. Glued portions of the bottom flap engage these side flap marginal portions. The central portion of the bottom flap is unglued and is not covered by the top flap. This unglued portion may be pulled downwardly to tear such slitted portions from the side flaps.

5 Claims, 6 Drawing Figures

ENVELOPES

BACKGROUND OF THE INVENTION

1. Field of the Invention

The present invention relates generally to the field of envelopes, and more particularly to improved envelopes which are adapted to be easily opened.

2. Description of the Prior Art

Many types and configurations of envelopes have, of course, been heretofore developed. Some of these contemplate spaced glued portions on the closure flap. This feature may be representatively shown in one or more of the following U.S. Pat. Nos.: 3,051,371; 2,083,158; 2,007,891; 3,464,621; 2,024,701; 1,092,660; and 1,044,935.

Others have also provided envelopes with slits or perforations on the closable flap, and this detail may be representatively shown in one or more of the following U.S. Pat. Nos.: 3,051,371; 1,336,646; 2,083,158; 3,464,621; 3,652,008; and 1,044,935.

SUMMARY OF THE INVENTION

The present invention provides improvements in an envelope having a front panel, a top flap, a bottom flap, and two side flaps.

In a first embodiment, the bottom flap is folded to have first marginal portions thereof overlap first marginal portions of the side flaps, and is glued to such side flap first marginal portions to form a back panel. The top flap may be selectively folded to have first marginal portions thereof overlap second marginal portions of the side flaps. The bottom flap is improved and is adapted to reinforce the back panel during stuffing, and is also adapted to facilitate opening of the envelope. The improved bottom flap includes a substantially T-shaped bottom flap having a central leg and two wings extending laterally therefrom in opposite directions. The leg is glued to third marginal portions of the side flaps, but the wings are unattached to the side flaps. The top flap first marginal portion is provided with cooperatively spaced glue portions which are adapted to adhere to the wings but not to the central leg. This improved envelope may be easily opened by grasping the unglued apex of the top flap and pulling the same in a suitable direction to tear the wings from the leg.

Another form of this improved envelope is top loading and bottom opening. In this form, first marginal portions of the side flaps are provided with a plurality of spaced slits or perforations, and each slit is substantially U-shaped. The bottom flap first marginal portion is provided with cooperatively-spaced glued portions which adhere to the first marginal portions of the side flaps. These glue portions are spaced from one another such that a central portion of the bottom flap proximate the apex thereof is not glued to the side flaps. This envelope may be opened by grasping the central portion of the bottom flap, and thereafter pulling the same in an appropriate direction to tear portions within such U-shaped slits from the side flaps.

Accordingly, one general object of the present invention is to provide an improved envelope.

Another object is to provide an improved envelope having a back panel reinforced against rough handling during stuffing.

Another object is to provide an improved envelope which may be easily opened.

Still another object is to provide an improved envelope which is top loading and bottom opening.

These and other objects and advantages will become apparent from the foregoing and ongoing specification, the drawings and the appended claims.

DESCRIPTION OF THE PREFERRED EMBODIMENTS

Figures 1, 2, 3, 4, 5, 6:
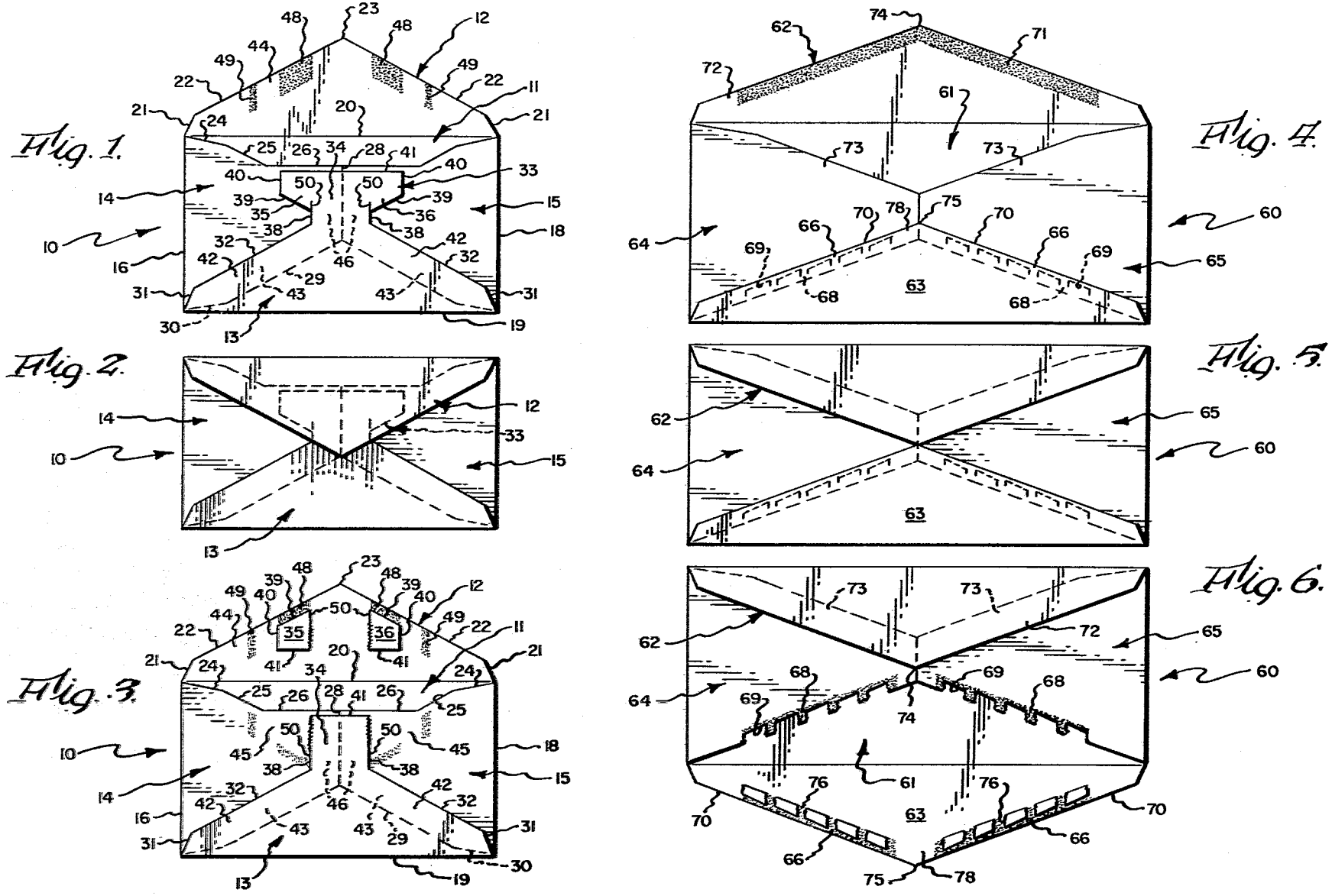
FIG. 1 is a rear elevation of a first preferred embodiment of the inventive envelope, this view showing the position of the top flap before the same is folded to close the envelope.
FIG. 2 is another rear elevation of the envelope shown in FIG. 1, but showing the top flap as having been folded to its sealed position.
FIG. 3 is another rear elevation of the envelope shown in FIG. 1, but showing the wings as having been torn from the leg when the envelope is opened.
FIG. 4 is a rear elevation of a second preferred embodiment of the envelope, this view showing the position of the open top flap prior to stuffing.
FIG. 5 is another rear elevation of the envelope shown in FIG. 4, but showing the position of the top flap in the closed or sealed position.
FIG. 6 is another rear elevation of the envelope shown in FIG. 4, but showing the bottom flap as having been torn open.

At the outset, it should be clearly understood that like reference numerals are intended to identify the same elements and/or structure consistently throughout the several drawing figures, as such elements and/or structure may be further described or explained by the entire written specification of which this detailed description is an integral part.

The present invention provides an improved envelope, of which two presently preferred embodiments are herein disclosed.

FIRST PREFERRED EMBODIMENT (FIGS. 1–3)

Referring now to FIGS. 1–3, a first preferred embodiment of the inventive envelope is generally indicated at 10. This envelope 10 broadly includes a horizontally-elongated rectangular front panel 11, a substantially triangular top flap 12, an improved bottom flap 13, and left and right side flaps 14, 15, respectively. In the conventional manner, envelope 10 may be formed of a single blank of paper, or other suitable material, and thereafter folded such that the bottom and side flaps will partially overlap one another to form the back panel of the open envelope.

More specifically, envelope 10 shown bounded by a left vertical folded edge 16, a right vertical folded edge 18, and a lower horizontal folded edge 19. Of course, when the top flap 12 is folded to close the envelope, such closed envelope is further bounded by an upper horizontal folded edge 20 (FIG. 2). However, for convenience in illustrating the improved envelope, this fold line 20 also appears in the open envelopes depicted in FIGS. 1 and 3.

Adverting now to FIG. 1, the top flap 12 is shown as being substantially triangular, and is specifically bounded by fold line 20; upwardly and inwardly inclined surfaces 21, 21; and upwardly and inwardly inclined surfaces 22, 22 which converge to form the apex 23 of the top flap. The left side flap 14 is shown as being bounded by left folded edge 16; an upper edge including series-connected edges 24, 25 and 26; a vertical right edge 28; and a lower edge including series-connected edges 29, 30. Inasmuch as the right side flap 15 is a mirror image of the left side flap, the right side flap will not be explicitly described, it being understood that the same reference numerals as applied to the left side flap are also used to indicate the corresponding edges of the right side flap. In the preferred embodiment, the edges 28, 28 of the left and right side flaps 14, 15 are arranged to substantially abut one another when the envelope blank is folded to the assembled condition, although this arrangement need not invariably obtain.

The improved bottom flap 13 is shown bounded by lower fold line 19, and has series-connected upwardly and inwardly inclined edges 31, 31 and 32, 32 joining a substantially T-shaped portion, generally indicated at 33. Specifically, this T-shaped portion 33 includes a central rectangular leg 34 from which a pair of left and right wings 35, 36, respectively, extend laterally in opposite directions. Still referring principally to FIG. 1, this T-shaped portion 33 is bounded by a pair of left and right vertical edges 38, 38 extending upwardly from the upper margins of edges 32, 32; upwardly and outwardly inclined edges 39, 39; vertical edges 40, upwardly and outwardly inclined edges 39, 39; vertical edges 40, 40 continuing upwardly therefrom and joining a horizontal top edge 41. So as to make explicit that which is implicit, the leg 34 of T-shaped portion 33 may be regarded as being bounded by imaginary vertical lines continuing upwardly from edges 38, 38, a central portion of top edge 41, and an imaginary horizontal line joining the lower margins of vertical edges 38, 38. Of course, the left and right wings 35, 36 are those portions to the left and right, respectively, of such imaginary vertical lines continuing upwardly from edges 38, 38.

In the conventional manner, the bottom flap is folded to have first marginal portions thereof, severally indicated at 42, overlap first marginal portions, severally indicated at 43, of the side flaps. These marginal portions 42, 43 are glued or otherwise suitably secured to one another to form the back panel of the envelope. The top flap may be selectively folded to have first marginal portions thereof, severally indicated at 44, overlap second marginal portions, severally indicated at 45, of the side flaps.

In the inventive envelope 10, the improved bottom flap 13 is adapted to reinforce the back panel when the envelope is stuffed, and is also designed to facilitate opening of the envelope. To this end, the leg 34 of bottom flap T-shaped portion 33 is glued to third marginal portions 46 of the left and right side flaps adjacent edges 28, 28 thereof. However, the wings 35, 35 are not glued or otherwise attached to the side flaps.

Moreover, the underside of the top flap first marginal portions are provided with spaced glue portions 48, 48 which are adapted to the wings 35, 36, but not to the leg 34. If desired, the top flap may be further provided with supplemental glue portions 49, 49 which are adapted to adhere to the side flaps.

Thus, when the glued portions 48, 48 and 49, 49 are moistened and the top flap is suitably folded to close the envelope, the glued portions 48, 48 will engage the wings 35, 36 of bottom flap T-shaped portion 33, but not the leg thereof. In this manner, a central portion of the top flap proximate the apex thereof, will not be attached to the back panel. This central unattached portion of the top flap may be subsequently grasped by a recipient of the envelope, and pulled upwardly to tear the wings 35, 36 from the leg 34 (FIG. 3). To facilitate this tearing separation of the wings from the leg when the envelope is opened, the T-shaped portion may be provided with a pair of vertical slits, severally indicated at 50, to facilitate the start of such tearing. It should be further noted that when the envelope is closed (FIG. 2), some parts of glue portions 48, 48 will overlap and engage parts of the side flap second marginal portions in addition to the wings. This is to insure the closure of the envelope, until it is desired to open the same. In this regard, it will be appreciated that such parts of glue portions 48, 48 as may adhere to the side flap second marginal portions, are relatively small in area and do not substantially interfere with the intended manner of opening the envelope. The same is true with respect to the optional supplemental glue portions 49, 49.

Therefore, the improved envelope 10 of the first preferred embodiment has an improved bottom flap provided with a uniqe T-shaped portion having a central leg attached to the side flaps and having wings extending laterally from this leg but not attached to the side flaps. Cooperative, spaced glue portions on the top flap first marginal portion engage the wings but not the leg of this T-shaped portion. The envelope is opened by grasping the central unglued portion of the top flap proximate the apex, and physically tearing the wings from the leg.

SECOND PREFERRED EMBODIMENT (FIGS. 4–6)

Referring now to FIGS. 4–6, a second preferred embodiment of the inventive envelope is generally indicated at 60. A with the first embodiment, this second embodiment 60 is shown as broadly including a horizontally-elongated rectangular front panel 61, a substantially triangular top flap 62, an improved bottom flap 63, a left side flap 64, and a right side flap 65. However, in this embodiment, the left and right side flaps 64, 65 are substantially trapezoidal in shape.

In the conventional manner, the bottom flap 63 may be substantially trangular and is folded to have first marginal portions, severally indicated at 66, thereof overlap first marginal portions, severally indicated at 68, of the left and right side flaps. These side flap first marginal portions 68 are shown as being provided with a plurality of inverted U-shaped slits, severally indicated at 69. Each of these slits has a spaced pair of lateral side slits, shown as being substantially vertical, and joined by a transverse or cross slit arranged to be substantially parallel to the adjacent inclined edge 70 of the bottom flap. Thus, in the embodiment illustrated, each of slits 69 appears to be substantially U-shaped and inverted. However, it should be clearly understood that these slits could be perforated or interrupted as well as being complete slits.

The top flap 62 may be suitabley folded to have a glued portion 71 along its first marginal portion 72 overlap and adhere to second marginal portions, severally indicated at 73, of the side flaps.

Referring now to FIG. 5, the improved bottom flap 63 is substantially triangular and is configured such that the apex 74 of the top flap will not cover the apex 75 of the bottom flap when the envelope is sealed. In the preferred embodiment, these two apices 74, 75 substantially abut one another when the envelope is closed. However, this configuration need not invariably be provided. Indeed, the sole design criteria is that the top flap not overlap or cover the bottom flap where the envelope is closed.

Referring now to FIG. 6, the bottom flap first marginal portions 66 are shown provided with spaced glue portions 76. These glue portions 76 are interrupted proximate the apex 75 so that a central flap 78 may be grasped and pulled downwardly to tear portions of the side flap first marginal portions within the U-shaped slits from the side flaps, thereby to facilitate opening of this envelope. Thus, the second envelope embodiment 60 is top loading and bottom opening. It should be further noted that the bottom flap glued portions 76 are adapted to adhere to the side flap first marginal portions 68 both between and within the slits 69. The omission of such glue from portion 78 insures that this portion may be grasped and suitably manipulated to complete the tears initiated by the slits 69. Thus, it is important that the top flap not overlap the bottom flap when the envelope is closed.

The disclosed embodiments illustrate two presently preferred embodiments of the present invention. While the first embodiment 10 is shown as providing a letter-size envelope, and the second is shown as providing a legal-size envelope, such improvement may be associated with virtually any type or size of envelope. As previously noted, slits 69 may alternatively be perforated, again as desired.

Therefore, while two presently preferred embodiments of the inventive envelope have been shown and described, persons skilled in this art will appreciate that various modifications and changes may be made without departing from the spirit of the invention which is generically defined in the following claims.

What is claimed is:

1. An envelope having a front panel, a bottom flap, a top flap, and two side flaps, and wherein said bottom flap is folded to have first marginal portions thereof overlap first marginal portions of said side flaps and is glued to said side flap first marginal portions to form a back panel, and wherein said top flap may be selectively folded to have first marginal portions thereof overlap second marginal portions of said side flaps, the improvement which comprises:

an improved bottom flap adapted to reinforce said back panel and adapted to facilitate opening of said envelope, said improved bottom flap including a substantially T-shaped portion having a leg and two wings extending laterally from said leg in opposite directions, said leg being glued to third marginal portions of said side flaps with said wings being unattached to said side flaps; and spaced glue portions provided on said top flap first marginal portions and adapted to adhere to said wings but not said leg;

whereby said envelope may be opened by grasping such unglued portion of said top flap overlapping said leg and pulling the same to tear said wings from said leg.

2. The improvement as set forth in claim 1 wherein said T-shaped portion is provided with a slit between said leg and each of said wings to facilitate such tearing when said envelope is opened.

3. The improvement as set forth in claim 1 wherein said spaced glue portions are arranged to overlap and adhere to said side flaps.

4. An envelope having a front panel, a substantially triangular bottom flap, a top flap, and two side flaps, and wherein said bottom flap is folded to have first marginal portions thereof overlap first marginal portions of said side flaps, and wherein said top flap may be selectively folded to have a glued portion along a first marginal portion thereof overlap and adhere to second marginal portions of said side flaps, the improvement which comprises:

a plurality of spaced slits provided in said first marginal portions of said side flaps, each of said slits being substantially U-shaped; and two glued portions provided on said bottom flap first marginal portions and adhering to said first marginal portions of said side flaps both between and within said slits, each of said glued portions extending inwardly of said bottom flap from an inclined edge thereof and extending therealong for a continuous distance, said glued portions being spaced from one another such that a central portion of said bottom flap proximate the apex thereof is not glued to said side flaps, whereby said envelope may be opened by grapsing said central portion of said bottom flap, and pulling said bottom flap to tear portions within said U-shaped slits from sid side flaps.

5. The improvement as set forth in claim 4 wherein said top flap has a substantially triangular shape, and wherein said top flap does not overlap said bottom flap when said envelope is closed.

* * * * *